US008132699B2

(12) United States Patent
Hess et al.

(10) Patent No.: US 8,132,699 B2
(45) Date of Patent: Mar. 13, 2012

(54) SHOULDER STRAP FOR BAG

(75) Inventors: Michael Hess, Pittsford, NY (US); Bryan Hammer, Rochester, NY (US); Stephen Spencer, Honeoye Falls, NY (US)

(73) Assignee: Three Point Ventures LLC, Rochester, NY (US)

( * ) Notice: Subject to any disclaimer, the term of this patent is extended or adjusted under 35 U.S.C. 154(b) by 291 days.

(21) Appl. No.: 11/960,086

(22) Filed: Dec. 19, 2007

(65) Prior Publication Data

US 2008/0142557 A1 Jun. 19, 2008

Related U.S. Application Data

(60) Provisional application No. 60/870,773, filed on Dec. 19, 2006.

(51) Int. Cl.
*A45F 3/12* (2006.01)

(52) U.S. Cl. ..... 224/264; 224/607

(58) Field of Classification Search ..... 224/264, 224/607, 642; 150/107, 108; 383/17; 2/460
See application file for complete search history.

(56) References Cited

U.S. PATENT DOCUMENTS

| | | | | | |
|---|---|---|---|---|---|
| 1,979,978 | A | * | 11/1934 | Martin | 190/115 |
| 3,896,694 | A | * | 7/1975 | Goldner | 84/280 |
| 4,550,869 | A | * | 11/1985 | Johnson | 224/607 |
| 4,976,388 | A | | 12/1990 | Coontz | |
| 5,143,266 | A | * | 9/1992 | Heckerman et al. | 224/150 |
| 5,411,194 | A | | 5/1995 | Nagasawa et al. | |
| 5,450,995 | A | | 9/1995 | Perrin | |
| 5,544,795 | A | | 8/1996 | Perrin | |
| 5,551,614 | A | | 9/1996 | Ham | |
| 5,615,811 | A | * | 4/1997 | Bell et al. | 224/150 |
| 5,647,522 | A | * | 7/1997 | Routh | 224/651 |
| 5,695,102 | A | | 12/1997 | Jackson | |
| 5,950,893 | A | * | 9/1999 | Heggeland | 224/578 |
| 6,158,636 | A | | 12/2000 | Latiolais | |
| 6,712,250 | B2 | * | 3/2004 | Vigny | 224/640 |
| 7,343,648 | B2 | * | 3/2008 | Shaw | 24/68 CD |
| 7,886,949 | B2 | * | 2/2011 | Fenton et al. | 224/652 |
| 2002/0179653 | A1 | * | 12/2002 | Klamm | 224/153 |
| 2004/0060951 | A1 | * | 4/2004 | Kelly | 224/264 |
| 2006/0186150 | A1 | * | 8/2006 | Willows et al. | 224/222 |
| 2006/0186163 | A1 | | 8/2006 | Suggs et al. | |
| 2007/0057002 | A1 | | 3/2007 | Timm et al. | |
| 2007/0261213 | A1 | | 11/2007 | Nolan et al. | |
| 2007/0262106 | A1 | * | 11/2007 | Fidrych et al. | 224/264 |

* cited by examiner

*Primary Examiner* — Justin Larson
*Assistant Examiner* — John Cogill
(74) *Attorney, Agent, or Firm* — LeClairRyan, a Professional Corporation

(57) ABSTRACT

The invention relates to an improved shoulder strap for use in combination with any type of bag that is designed for carrying over a shoulder of a user. The shoulder strap includes: first and second half-straps each having a first end and a second end, the second end having a connector adapted for coupling to a bag; a pad; and at least one elastic member held on one side of the pad and being extendable independently of the pad, the at least one elastic member coupling the first end of the first half strap to the pad and the first end of the second half strap to the pad.

10 Claims, 4 Drawing Sheets

SHOULDER STRAP FOR BAG

This application claims the priority benefit of U.S. Provisional Patent Application Ser. No. 60/870,773, filed Dec. 19, 2006, which is hereby incorporated by reference in its entirety.

BACKGROUND OF THE INVENTION

The present application relates to a shoulder strap that is designed for use with any type of bag that is typically carried over one's shoulder.

Carrying a bag over one's shoulder can cause great stress to the user's back, neck, shoulder, or side. To minimize the stress imposed upon the user's body, particularly when the contents of the bag are somewhat heavy, the present invention affords a shoulder strap that will reduce the stress applied to the user's body. Consequently, the shoulder strap will be much more comfortable for users.

Others have designed shoulder strap assemblies with this in mind, but none achieves this objective with a simplified, effective construction that is durable.

For instance, U.S. Patent Application Publ. No. 2007/0261213 describes a shock absorbing shoulder strap that utilizes elastic half-straps that are coupled to the shoulder pad itself. This construction leaves the elastic component vulnerable to unnecessary wear, because the elastic component is exposed during use. Similar deficient constructions are illustrated in U.S. Pat. Nos. 6,158,636, 5,544,795, 5,450,995, and 5,411,194.

While the strap design of U.S. Pat. No. 5,695,102 avoids exposure of the elastic component, the solution described in this reference is achieved by integrating the elastic component into a unitary multilaminar construction of the shoulder pad per se. This design involves the use of substantially all elastic materials in the construction of the shoulder pad, including outer layers of soft stretchable materials, stretchable padding materials, and an internal elastic member that is covered by the outer layers. The design and construction of this shoulder pad is relatively complicated given that the entire should pad itself is elastic. Moreover, the entire shoulder pad will expand and contract during use. This may become uncomfortable to the user, because it may result in shifting or bunching of the user's clothing.

The present invention is directed to overcoming these and other deficiencies in the art

SUMMARY OF THE INVENTION

A first aspect of the present invention relates to a shoulder strap that includes: first and second half straps each having a first end and a second end, the second end having a connector adapted for coupling to a bag; a pad; and at least one elastic member held on one side of the pad and being extendable independently of the pad, the at least one elastic member coupling the first end of the first half strap to the pad and the first end of the second half strap to the pad.

According to one preferred embodiment, the pad is substantially inelastic (though flexible enough to conform to a user's shoulder) and includes only one elastic member that has a loop configuration. The elastic member is capable of extension in both longitudinal directions, i.e., extendable lengthwise toward the opposite ends of the pad.

According to another preferred embodiment, the pad is substantially inelastic (though flexible enough to conform to a user's shoulder) and includes two elastic members, each of which has a loop configuration. Each elastic member is retained at one end thereof, but is capable of extension toward the associated end of the pad.

A second aspect of the present invention relates to a bag that includes a shoulder strap according to the first aspect of the present invention.

The present invention offers a simplified construction of a shoulder strap that does not involve complicated construction of the shoulder pad per se. Moreover, the elastic component, due to its location onto an external surface of the shoulder pad, is sufficiently protected from unnecessary wear. In addition, the elastic member can be held on the shoulder pad in such a manner that offers aesthetically pleasing appearance that can receive brand labeling or the like.

DETAILED DESCRIPTION OF THE INVENTION

Figure 1:
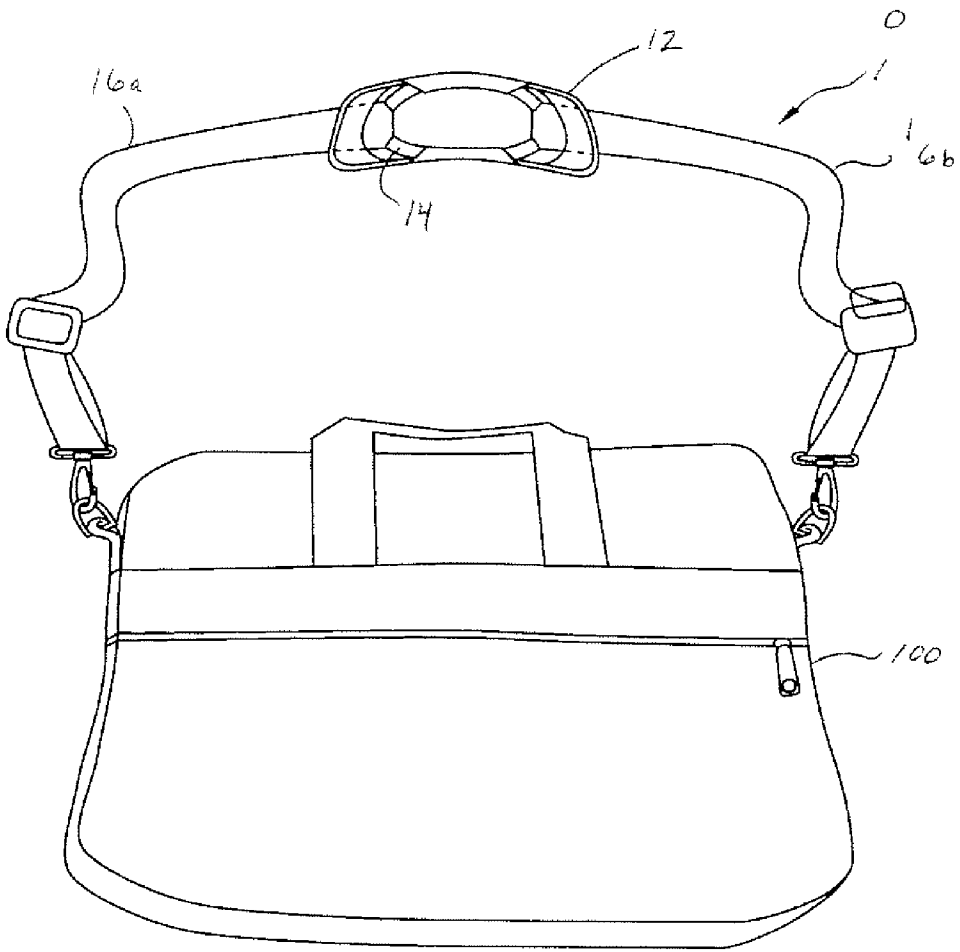
FIG. 1 is a perspective view showing a shoulder strap according to a first embodiment while coupled to a bag.

The shoulder strap of the present invention includes first and second half straps, a shoulder pad, and at least one elastic member that connects the half straps to the shoulder pad and extends independently of the shoulder pad.

The first and second half-straps each have a first end and a second end. The second end of each of the first and second half-straps has a connector adapted for coupling to a bag. The connector can be any type of connector, but preferably is a releasable connecter to allow the shoulder strap to be released from the bag. The first end of each of the first and second half-straps is connected to the at least one elastic member by any suitable means.

The first and second half-straps can be of the same or different construction. According to a preferred construction, the first and second half-straps are formed of a woven web of nylon and include appropriate adjustment buckles to allow for shortening or lengthening the strap, and the connector attached to the second end includes a spring-biased clasp mechanism to resist uncoupling except as desired by the user. The first end of the half-straps are preferably connected to the at least one elastic member via a substantially permanent connection.

The at least one elastic member is preferably in the form of one or more closed loop bungee cords whose ends having been joined together, either by mechanical linkage or by physically fusing the ends (i.e., via heat fusion or the like). The at least one elastic member should have a thickness and tensile strength that is sufficient for the type of bag with which the shoulder strap is intended to be used. For example, a briefcase or laptop bag may not require as strong an elastic member as a golf bag or large piece of luggage, but will certainly require a stronger elastic member as compared to a small camera bag or the like. In other words, the strap itself can be tailored for its intended use.

The at least one elastic member is preferably held onto the shoulder pad in a manner that allows the at least one elastic member to extend in both longitudinal directions, i.e., extendable lengthwise toward the opposite ends of the pad. Suitable means of securing the at least one elastic member in this manner include, without limitation, one or more retaining loops that are connected to the top surface of the shoulder pad with the at least one elastic member passing through the one or more retaining loops. The retaining loops allow the at least one elastic member to slide or move through the loops, i.e., independently of the pad. This allows the at least one elastic member to expand and contract freely, while the pad remains positioned on a user's shoulder.

As noted above, the first ends of the half-straps are preferably connected permanently to the at least one elastic member. Suitable permanent connections include, without limitation, a sewn loop formed at the first end of the half-straps with the at least one elastic member passing through the loop, and a sewn loop as recited above except that the loop is formed around a ring (e.g., O-ring, D-ring, etc.) with the at least one elastic member passing through the ring. Of these approaches, the former is presently preferred because it will tend to disperse the load across a portion of the at least one elastic member and better resist wear and tear.

The shoulder strap is intended to be used in combination with a bag, which includes appropriate connectors for coupling with the connectors on the second end of the half-straps. The bag can be any type of bag that is intended to be carried over a user's shoulder. Exemplary bags include, without limitation, laptop bags, camera bags, briefcases, luggage, golf bag, etc.

Figure 2:
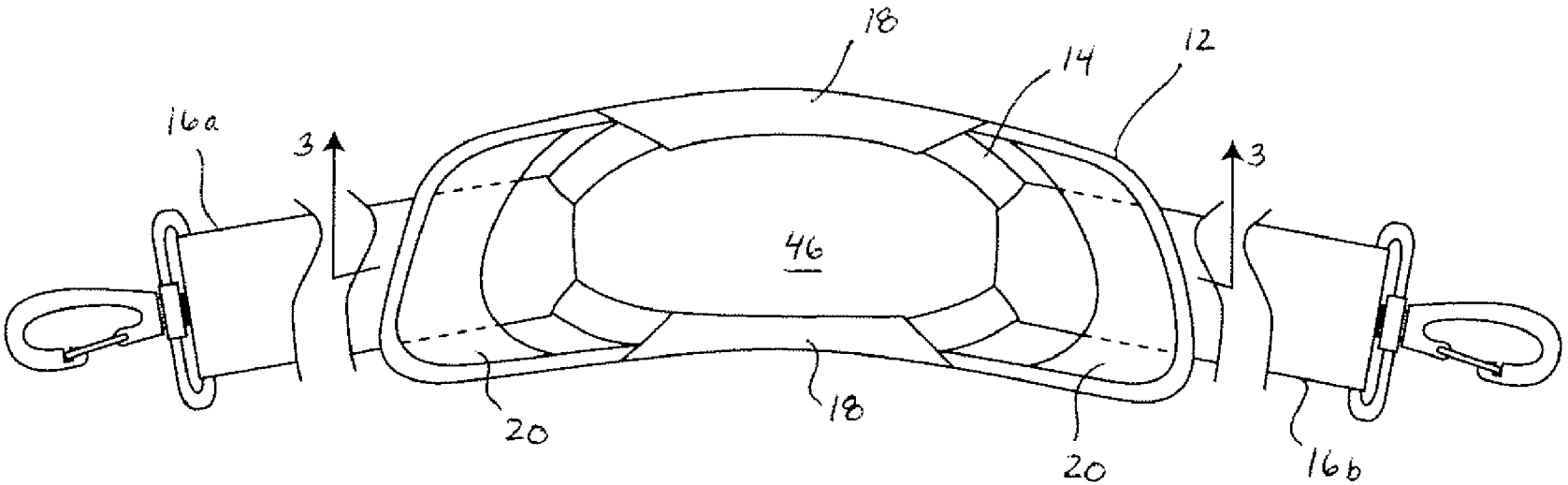
FIG. 2 is an enlarged, top plan view of the shoulder strap of the first embodiment shown in FIG. 1.
Figure 3:
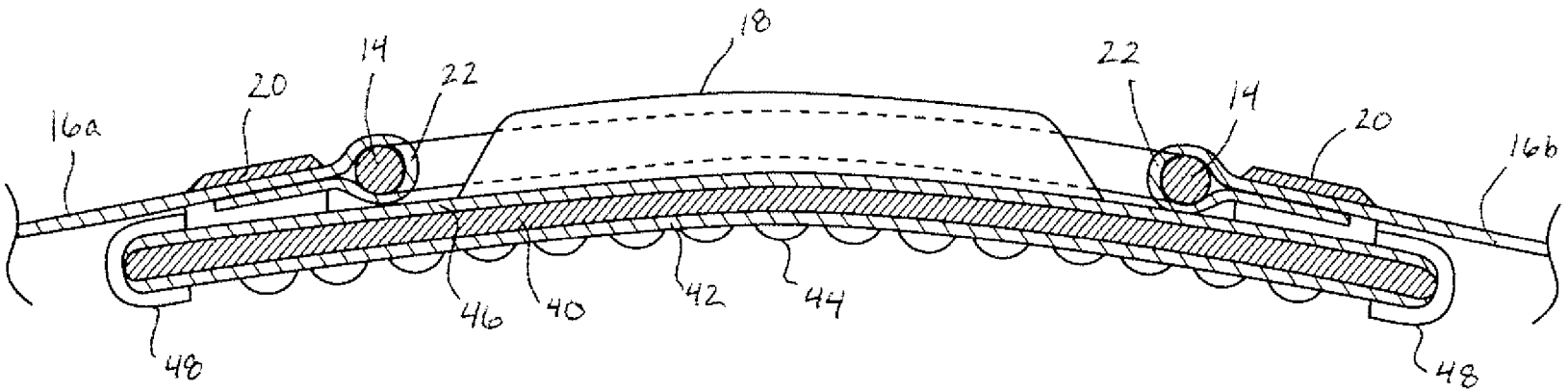
FIG. 3 is a cross sectional view of the first embodiment shown in FIG. 2 as taken along line 3-3.

Referring now to the embodiment illustrated in FIGS. 1-3, the shoulder strap 10 includes a shoulder pad 12, a single elastic member 14, and half-straps 16*a,b*. The strap 10 is shown coupled to bag 100.

The shoulder pad 12 can be fitted with any conventional cushioning design. As shown in FIG. 3, the shoulder pad 12 includes a foam layer 40 and a layer 42 that includes multiple integrated air cells 44. These layers are secured together with a covering material 46 by stitching or other means of connection. The edges of the cover material 46 and the layers 40 and 42 can be covered with an attractive seam cover 48. The covering material 46 and seam cover 48 are both preferably formed of a durable nylon or polymer fabric material.

The shoulder pad 12 also has secured thereon one or more retaining members that hold the elastic member 14 on one side of the pad and such that the elastic member is extendable independently of the pad. One preferred construction is illustrated in FIGS. 2 and 3, where a lateral retaining member 18 is provided along each long edge of the pad 12 and a transverse retaining member 20 is provided at each end of the pad.

The lateral retaining members 18 are formed as loops of fabric that are stitched together at the seam about the perimeter of the pad. Each of the lateral retaining members 18 is somewhat elongate, but it should be appreciated that a plurality of spaced retaining members could also be employed along each long edge of the pad. These lateral retaining members loosely retain the elastic member 14, allowing it to expand and contract in both longitudinal directions (i.e., along the length of the shoulder strap). The lateral retaining members 18 are preferably formed of a durable nylon or polymer fabric material.

The transverse retaining members 20 span across the top surface of the shoulder pad 12 adjacent the ends thereof. The transverse retaining members 20 are secured at the lateral edge seam (but not at the ends of the pad) by stitching, and form a non-adjustable strip of fabric material that extends across the top surface of the pad. The dimension of the retaining member 20 is not critical, and can be varied for aesthetic design considerations. Given the manner in which the transverse retaining members 20 are secured to the pad, each half-strap 16*a,b* has its first end pass between the top surface of the shoulder pad 12 and one of the transverse retaining members 20.

In this embodiment, the single elastic member 14 has a loop configuration that passes through the pair of lateral retaining members 18. As noted above, the retaining loops 18 allow the single elastic member 14 to float on the shoulder strap 12 and move independently thereof. This allows the single elastic member to expand under load and contract to its original shape when the load is removed. Specifically, the single elastic member is positioned between the transverse retaining members 20 while it remains under no load, but is capable of traveling between each retaining member and the pad once it is placed under a load sufficient to cause such expansion of the elastic member 14.

Each half-strap 16*a,b* has a sewn loop 22 formed at its first end. The single elastic member 14 passes through each of the loops 22, thereby connecting each of the half-straps 16*a,b* to the shoulder pad 12.

In use, the second ends of each of half-straps 16*a,b* is coupled to a suitable bag (see FIG. 1). When the load is sufficient to cause expansion of the single elastic member, i.e., as a user moves while carrying the shoulder strap, the elastic member expands in the direction of the half-straps to minimize the stress borne by the user's shoulder.

Figure 4:
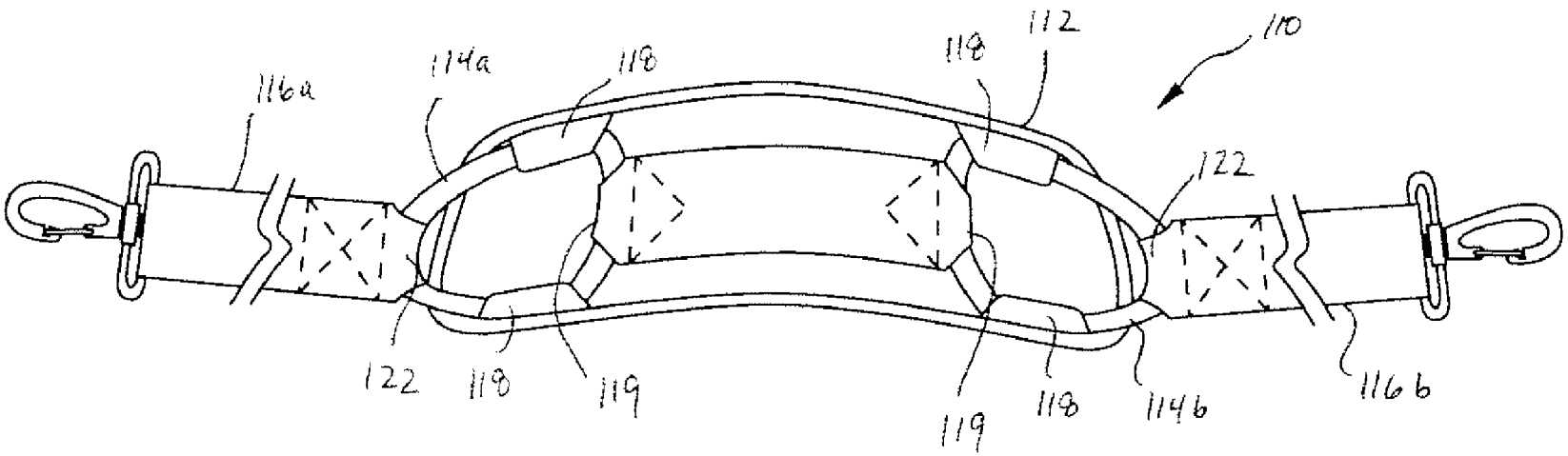
FIG. 4 is a top plan view of a shoulder strap according to a second embodiment of the invention.

Referring now to the embodiment illustrated in FIG. 4, the shoulder strap 110 includes a shoulder pad 112, pair of elastic members 114*a,b*, and half-straps 116*a,b*.

The shoulder pad 112 is similar in construction to pad 12, except that the plurality of lateral retaining members 118 is positioned to accommodate the two separate elastic members 114*a,b*. Unlike the shoulder pad 12 of the first embodiment, the shoulder pad 112 does not possess any transverse retaining members 20. Instead, a central retaining member 119 is provided for each of the elastic members 114*a,b*. The central retaining member 119 is shown in the form of nylon strap material having a pair of sewn loop configurations through which the pair elastic members pass, respectively.

Each elastic member 114*a,b* has a loop configuration and passes through retaining members 118, 119 that are secured to the top surface of the shoulder pad 112. The retaining members 118, 119 allow each elastic member 114*a,b* to float on the shoulder strap 112 and move independently thereof. This allows the elastic members to expand under load and contract to their original shape when the load is removed. In contrast to the first embodiment, where the single elastic member was capable of expanding and contracting in both longitudinal directions along the length of the pad, in this embodiment each elastic member 114*a,b* is capable of expanding only in one longitudinal direction.

Each half-strap 116*a,b* has a sewn loop 122 formed at its first end. The elastic member 114*a* passes through loop 122 of half-strap 116*a* and elastic member 114*b* passes through loop 122 of half-strap 116*b*, thereby connecting each of the half-straps 116*a,b* to the shoulder pad 112 via the associated elastic member.

In use, the second ends of each of the half-straps 116*a,b* is coupled to a suitable bag. When the load is sufficient to cause expansion of the two elastic members, i.e., as a user moves while carrying the shoulder strap, the elastic members expand in the direction of the half-straps to minimize the stress borne by the user's shoulder.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A shoulder strap comprising:

first and second half straps each having a first end and a second end, each second end having a connector adapted for coupling to a bag;

a flexible, but substantially inelastic pad having an upper surface and a lower surface disposed to contact a user's shoulder during use; and a single elastic member retained upon the upper surface of the pad by one or more retaining members permanently affixed to the upper surface of the pad, wherein the single elastic member passes through the one or more retaining members and is freely movable between the pad and the one or more retaining members, the single elastic member being extendable independently of the pad along lengthwise directions of the pad, and the single elastic member coupling the first end of the first half strap to the pad and the first end of the second half strap to the pad, whereby the both first and second half straps, when under load, can move independently of the pad upon expansion and contraction of the single elastic member.

2. The shoulder strap according to claim 1 further comprising:

first and second terminal retaining members permanently affixed to the upper surface of the pad adjacent to its opposed ends, wherein the first end of the first half strap passes and is movable between the upper surface of the pad and the first terminal retaining member and the first end of the second half strap passes and is movable between the upper surface of the pad and the second terminal retaining member.

3. The shoulder strap according to claim 2 wherein the first and second terminal retaining members are positioned on the pad transverse to the half straps.

4. The shoulder strap according to claim 3 wherein the single elastic member comprises a loop configuration and is positioned between the first and second terminal retaining members while the single elastic member remains under no load but is capable of traveling between the upper surface of the pad and one or both of the terminal retaining members when the single elastic member is placed under a sufficient load.

5. A bag comprising a shoulder strap according to claim 1.

6. The bag according to claim 5 wherein the bag comprises first and second connectors adapted for mating engagement with, respectively, the connectors on the second ends of the first and second half straps.

7. The bag according to claim 5 wherein the bag is configured as a laptop bag, a briefcase, or a piece of luggage.

8. The shoulder strap according to claim 1 wherein the single elastic member comprises a loop configuration.

9. The shoulder strap according to claim 1 wherein the first end of each of the half straps comprises a loop through which the single elastic member passes.

10. The shoulder strap according to claim 1 wherein either one or both of the first and second half straps is adjustable in length.

* * * * *